United States Patent [19]

Greiner et al.

[11] 4,373,496

[45] Feb. 15, 1983

[54] APPARATUS FOR CONTROLLING AN EXHAUST RECIRCULATION DEVICE IN INTERNAL COMBUSTION ENGINES

[75] Inventors: Max Greiner, Gerlingen; Klaus Krieger, Affalterbach, both of Fed. Rep. of Germany; Gottfried Schiller, Chicago, Ill.; Wolf-Rüdiger Walk; Ludwig Walz, both of Stuttgart, Fed. Rep. of Germany

[73] Assignee: Robert Bosch GmbH, Stuttgart, Fed. Rep. of Germany

[21] Appl. No.: 206,594

[22] Filed: Apr. 1, 1981

[51] Int. Cl.[3] ..... F02M 25/06

[52] U.S. Cl. ..... 123/569; 123/571

[58] Field of Search ..... 123/569, 568, 571

[56] References Cited

U.S. PATENT DOCUMENTS 4,228,773 10/1980 Stumpp et al. ..... 123/568 X 4,300,515 11/1981 Straubel et al. ..... 123/569 X

*Primary Examiner*—Wendell E. Burns

*Attorney, Agent, or Firm*—Edwin E. Greigg

[57] ABSTRACT

An apparatus is proposed for controlling an exhaust recirculation device in internal combustion engines, in which a throttle device in an exhaust recirculation line is opened on the condition that the position of the load-adjusting lever of a fuel injection pump associated with the engine falls below a maximum load position and that the adjusting member of an rpm governor of the fuel injection pump is below a predetermined deflection position and/or is operated above a lower rpm value. With an embodiment of this kind, the control of exhaust recirculation quantities can be performed in a simple and functionally reliable manner for the various operational points of the engine with the greatest possible approximation of the permissible values.

30 Claims, 5 Drawing Figures

APPARATUS FOR CONTROLLING AN EXHAUST RECIRCULATION DEVICE IN INTERNAL COMBUSTION ENGINES

The present invention relates to an apparatus for controlling an exhaust gas recirculation device in an internal combustion engine, which is supplied with fuel by a fuel injection pump having a fuel quantity adjusting device and an adjusting lever which acts thereon via a governor spring for load adjustment.

BACKGROUND OF THE INVENTION

In such a known apparatus, a centrifugal adjuster is provided which acts upon the fuel quantity adjusting device counter to the force of the governor spring, which is prestressed by the adjusting lever. Beyond a predetermined deflection of the adjusting sleeve of the centrifugal governor, communication is furnished between the suction chamber of the injection pump and an outflow line, in which a throttle is arranged to provide a control pressure which serves to actuate an exhaust recirculation dispensing device. The extent of communication between the suction chamber and the outflow line is continuously varied in accordance with the displacement of the fuel quantity adjusting device, so that for adjusting the exhaust recirculation dispensing device a control pressure is established which varies with the position of the fuel quantity adjusting device. The arrangement is such that a full load the recirculation of exhaust gas is precluded and at partial load fuel is supplied.

The apparatus of the prior and background art has the disadvantage, however, that the rpm dependency of the fuel quantity supply when the position of the fuel quantity adjusting device remains the same is not taken into consideration. This characteristic of the fuel injection pump means that while at low rpm the position of the fuel quantity adjusting device can still be utilized as a control variable for the quantity of recirculated exhaust gas, fuel quantities are injected, with the fuel quantity adjusting device remaining in a constant position, even in the middle rpm range at which a recirculation of exhaust gas should no longer be effected, for reasons having to do with soot emission and engine output. It is accordingly not assured that a sufficiently large quantity of exhaust gas can be recirculated at all operational rpm levels of the engine, except in the starting and warmup range, while fully exploiting the permissible limits of exhaust gas recirculation.

OBJECTS AND SUMMARY OF THE INVENTION

The apparatus according to the invention having an improved exhaust gas recirculation device tied to the adjusting lever of the fuel injection pump of the engine has the advantage over the prior art that exhaust gas can be recirculated to a much greater extent, over a desired rpm range, with a substantially closer approach to the permissible limit of exhaust gas recirculation. The apparatus according to the invention can also be realized with simple means.

It is particularly advantageous that the signal which is rpm-dependent at least at constant load represents the position of an adjusting member of a mechanical rpm transducer coupled with the fuel quantity adjusting device. This signal is valid for the low rpm range of the performance graph. In this range, the limitation of the exhaust gas recirculation is effected using solely the adjusting lever signal when the fuel injection values are excessively high. In contrast, with the adjusting lever signal in the other ranges of the performance graph of the engine, the limit for the exhaust gas recirculation can be maintained while approaching the maximum permissible value quite closely.

The invention will be better understood and further objects and advantages thereof will become more apparent from the ensuring detailed description of four preferred embodiments, taken in conjunction with the drawings.

DETAILED DESCRIPTON OF THE PREFERRED EMBODIMENTS

The recirculation of controlled quantities of exhaust gas into the intake tube of an internal combustion engine has proved to be an effective means of reducing the amount of toxic substances in the exhaust gases of the engine. In self-igniting engines in particular, the high $NO_x$ component can be reduced. These freely aspirating engines, guided by the fuel injection quantity, are operated in the partial-load range with a substantial air excess, which can be reduced by mixing with the air a quantity of recirculated exhaust gas. As a result, combustion is affected such that the content of toxic $NO_x$ substances is reduced. In so doing, however, it is necessary to make the actual exhaust recirculation rates be as close as possible to the maximal permissible exhaust recirculation rate for all load and rpm points of the engine.

Despite the existence of various known and relatively complicated closed-loop control devices for the recirculation of exhaust gases, the requirement remains that such devices should be made as simple and reliable in function as possible. Especially in small cars, an inexpensive, simple and yet still sufficiently effective means is needed for controlling the quantity of recirculated exhaust gas, with concessions being made for the sake of approaching the maximal permissible exhaust recirculation rate. An essential criterion for the maximal permissible exhaust recirculation rate is the amount of the fuel injection quantity per injection procedure. In particular, for instance in full-load operation or during starting enrichment, it is desirable to preclude the recirculation of the exhaust gases, in order not to reduce engine output in these engine ranges. In the other engine ranges, a good result on the average can be attained in the exhaust composition with an appropriately adapted average exhaust recirculation quantity.

Figure 1:
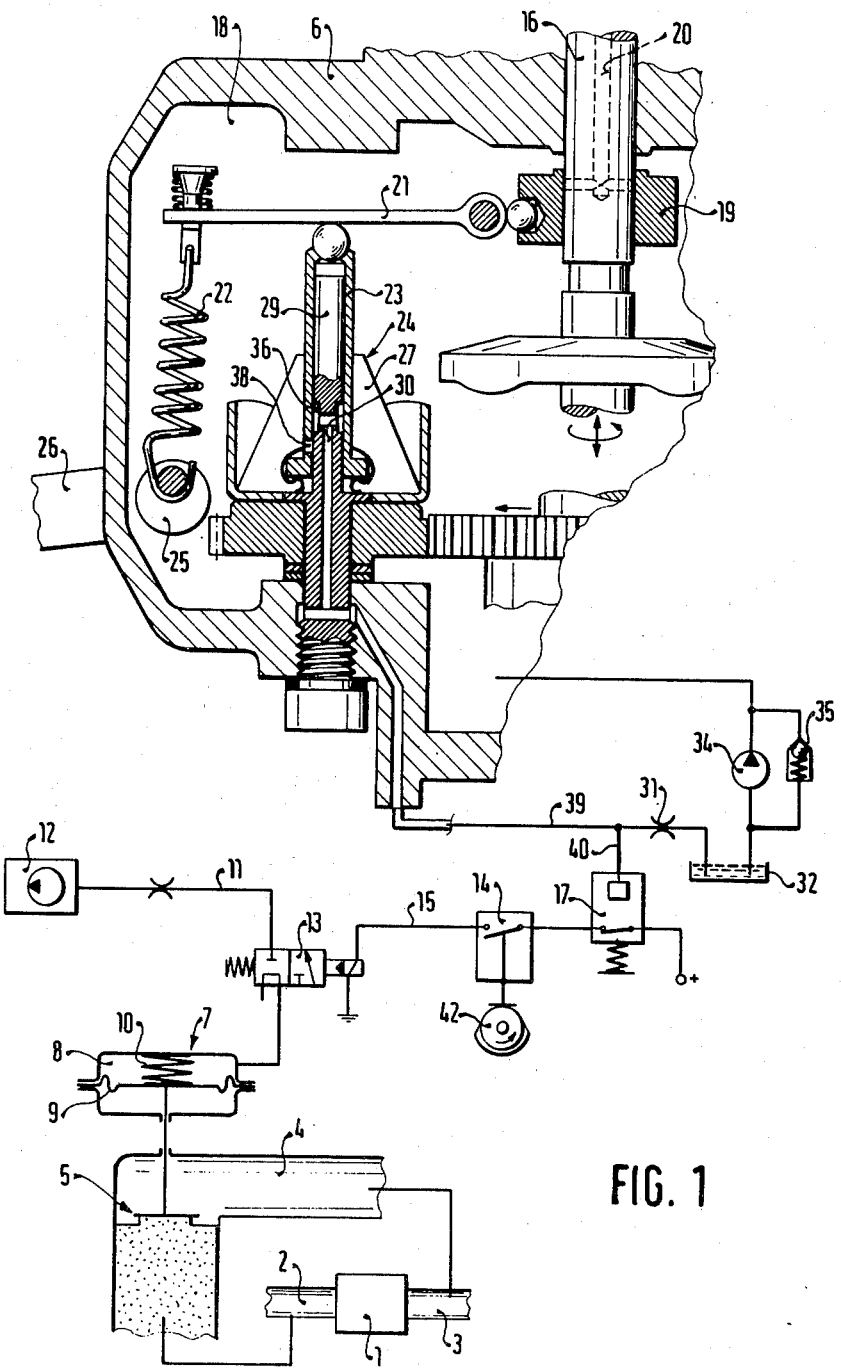
FIG. 1 shows a first exemplary and schematic embodiment of the invention with an exhaust gas recirculation device actuated by auxiliary force and controlled by the position of the adjusting lever and by the position of the adjusting member of the rpm transducer.

In referring to the drawings including FIG. 1, there is an internal combustion engine 1 shown schematically, having an exhaust manifold line 2 and an intake tube 3. Discharging into the intake tube 3 is an exhaust gas recirculation line 4 branching off from the exhaust manifold line 2 and having a built-in exhaust gas recirculation valve 5, which is actuated by an adjusting device comprising a pneumatic servomotor 7. The servomotor 7 has a work chamber 8, which is defined by an adjusting diaphragm 9 connected with the exhaust recirculation valve 5 and urged in the closing direction of the exhaust recirculation valve 5 by a spring 10.

The work chamber 8 communicates via a pressure line 11 with a source of underpressure 12, with a switching valve 13 being inserted into the pressure line. The switching valve 13 is magnetically actuatable and in its position of rest it holds the pressure line 11 closed.

A first switch 14 and a pressure switch 17 are disposed in series in an electric current supply line or switching line 15 of the electromagnetically actuatable switching valve 13. The switching valve 13 cannot be actuated until both switches 14 and 17 are closed.

A portion of a distributor injection pump is also shown in FIG. 1; however, the application of the invention is not restricted to a pump of this type. The pump has a pump piston 16, by way of example, acting as a fuel quantity supply and dispensing device, which simultaneously reciprocates and rotates, thus acting as a distributor. The pump chamber of the pump piston 16, not shown, can be made to communicate via a relief line 20 with a pump suction chamber 18. The relief line 20 exits at the jacket of the portion of the pump piston 16 which protrudes into the pump suction chamber 18, with the exit opening being controlled by means of an annular slide 19 associated with the pump piston 16. After a shorter or longer supply stroke by the pump piston 16, depending upon the position of the annular slide 19, the relief line 20 is opened, thus terminating injection.

The annular slide 19 is adjustable with the aid of a lever 21 acting as the fuel quantity adjusting device. A governor spring 22 and a governor sleeve 23 of a centrifugal governor 24 engage the other end of the lever 21. In place of the governor sleeve, a different adjusting member of an rpm transducer may be used instead.

The prestressing of the governor spring 22 is adjustable via an eccentric 25 with the aid of an adjusting lever 26 with which the amount of intended torque can be expressed. The governor sleeve 23 engages the lever 21 in a known manner counter to the force of the governor spring 22. The governor sleeve 23 is adjusted by flyweights 27, which are driven to rotate in proportion to the pump rpm. The governor sleeve 23 is displaced to a greater or lesser extent at a predetermined rpm depending upon the prestressing of the governor spring 22, so that the annular slide 19 also assumes a higher or lower position relative to the pump piston 16. The position of the governor sleeve 23, as well as of the lever 21 and the annular slide 19, variously represent a standard for the load established at that time.

In a further improvement, an axial bore 30 is provided in the carrier 29 on which the governor sleeve 23 is displaceable. This bore 30 leads out of the housing of the injection pump 6 and discharges there into a discharge line 39, which leads via a throttle 31 to the fuel supply container 32. From there, the pump suction chamber 18 is supplied with fuel via a supply pump 34, with the fuel pressure in the pump suction chamber 18 being controlled by a pressure regulation valve 35 disposed parallel to the supply pump 34.

The end of the bore 30 discharges into an annular groove 36 disposed on the carrier 29 of the governor sleeve 23. The governor sleeve 23 sliding on the carrier 29 thereby closes this annular groove 36, at least in its rest position. The governor sleeve 23 further has an opening 38 in its cylindrical wall. Beyond a certain amount of deflection of the governor sleeve 23, this opening 38 advances to overlap the annular groove 36, which makes it possible for fuel to flow out of the suction chamber 18 and back to the fuel supply container 32 via the bore 30 and the throttle 31.

A control line 40 leading to the pressure switch 17 branches off upstream of the throttle 31 from the line 39 connecting the bore 30 with the fuel supply container 32. This pressure switch 17 is designed such that whenever a control pressure is established at the throttle 31—that is, whenever the governor sleeve 23 has traveled a predetermined distance—the switch 17 opens and the connection in the electric current supply line 15 is interrupted. The first switch 14 disposed in series to this switch 17 is actuated by a cam disc 42, which is rotated together with the adjusting lever 26. Beyond a predetermined load position, the first switch 14 is opened by the cam disc 42, so that here as well the connection in the electric current supply line 15 is interrupted. Only when both switches 14 and 17 are closed can the switching valve 13 be actuated, which causes an opening of the exhaust recirculation valve 5.

The functioning of the apparatus shown in FIG. 1 will now be explained with the aid of the diagram in FIG. 2.

Figure 2:
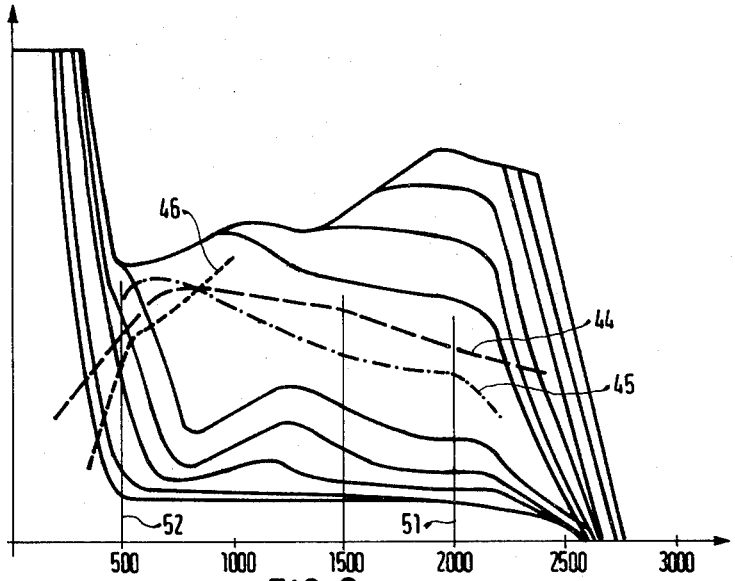
FIG. 2 is a diagram with the performance graph of an internal combustion engine operated with the apparatus according to the invention.

The solid lines in the diagram of FIG. 2 are the lines of a constant position of the adjusting lever 26. In the middle rpm range between 800 and 2200 rpm, these lines are approximately parallel to the abscissa, with the lowermost line representing idling operation and the topmost line representing full-load operation. The fuel injection quantity per stroke is plotted on the ordinate. A broken line 44 represents the set-point curve for the fuel injection quantity, up to which the exhaust gas recirculation can be performed. The position of the curve is dependent upon the characteristic of the engine and at 2200 rpm is located approximately in the middle between the full-load injection quantity and the idling injection quantity. At low rpm the curve sloped upward slightly, then drops somewhat more sharply at about 700 rpm. A second, dot-dash line 45 represents one of the curves for constant lever position, which very closely approximates the set-point curve 44. A second broken line 46 represents the curve indicating the injection quantity at a constant position of the governor sleeve 23 or a constant position of the annular slide 19. Injection pumps which operate with closed-loop overflow control, such as those described herein at the outset, have the characteristic that the quantity of fuel being injected increases relatively sharply with increasing rpm when the fuel quantity adjusting member (that is, the annular slide 19) remains in a constant position. That is also shown by the curve 46, which, beginning with a relatively low injection quantity at a low rpm of about 500, rises relatively steeply and in the illustrated example already passes the set-point curve 44 at 800 rpm. The outset point of the curve 45 ideally is located below the set-point curve 44 and is very well suited to effecting a limitation of the exhaust recirculation. Only the last portion of the curve already attains, at a relatively low rpm, fuel injection values at which a recirculation of exhaust gas can no longer be permitted to occur. Thus, it is not possible to use a predetermined position of the governor sleeve 23 as a threshold value for the recirculation of exhaust gas.

Thus according to the invention both the curve 46 for constant governor-sleeve position and the curve 45 for a predetermined constant adjusting-lever position are utilized as a threshold value for the recirculation of exhaust gas. The first switch 14 and the pressure switch 17 are provided accordingly, here performing the function of an AND gate. With the aid of the described embodiment of the governor sleeve 23 and the carrier 29, a control signal for the pressure switch 17 can be generated in simple fashion. Naturally, an appropriate signal can also be attained with suitable travel-path transducers. So long as the opening 38 is not overlapping the annular groove 36, the pressure switch 17 remains closed. Even at adjusting-lever positions which are smaller than the adjusting position associated with curve 45, the first switch 14 is closed. The switching valve 13 is accordingly opened, as is the exhaust gas recirculation valve 5. If the governor sleeve 23, approximately in the rpm range between 400 rpm and 800 rpm in accordance with the values given by way of example in FIG. 2, is deflected to such an extent that fuel can flow out via the bore 30, then the pressure switch 17 is opened and the supply of electric current to the switching valve 13 is precluded independently of the position of the first switch 14, and the switching valve 13 accordingly assumes its closed position. In this position, the work chamber 8 of the pneumatic servomotor 7 is ventilated, so that the exhaust gas recirculation valve 5 is also brought into its closed position under the influence of the compression spring 10. The same process takes place in the rpm range over approximately 800 rpm whenever a larger position of the adjusting lever is established than that which is represented by the curve 45. In that case, the first switch 14 opens.

Figure 3:
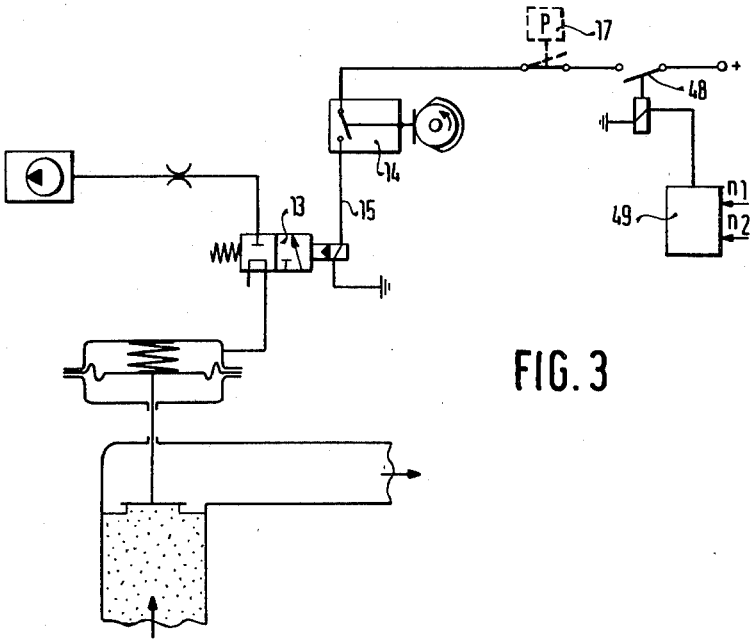
FIG. 3 shows a second exemplary and schematic embodiment of the invention with control of an auxiliary force for actuation of the exhaust gas recirculation dispensing device in accordance with the presence of the adjusting lever signal and of a signal for the exceeding of a first or of a supplementary, second rpm threshold.

In FIG. 3, a modified form of embodiment is shown for the triggering of the switching valve 13. Here, as well, the first switch 14 is provided in the electric current supply line 15, just as in the embodiment shown in FIG. 1. A second switch 48 is provided in series to the switch 14 and is controlled by a control device 49. The control device 49 receives at least an rpm signal from an rpm transducer, not shown here in further detail, which detects the actual rpm of the engine. In the control device 49, the actual rpm signal is compared in a manner known per se with an rpm threshold value in such a way that when the threshold value is exceeded the control device 49 emits a signal to open the switch 48. This threshold value may be set at 2000 rpm by way of example, as indicated in FIG. 2 by the line 51. The control device 49 further contains a second comparator device, in which the actual rpm is compared with a second, lower thredhold value, and when there is a failure to attain this lower threshold the switch 48 is also opened. This second, lower threshold value is represented by the line 52 in the diagram of FIG. 2.

However, it is also possible for the comparator device for the upper threshold value represented by line 51 to be eliminated, in engines in which exhaust gas can still be recirculated up to the shutoff rpm level. On the other hand, in place of the comparator device for the lower threshold value, or in addition thereto, a pressure switch 17 can be provided in the electric current supply line 15 as shown in FIG. 1. With the aid of the combination described, it is possible to recirculate exhaust gas in quite close approximation of the ideal values in a predetermined range of the performance graph of the engine.

Figure 4:
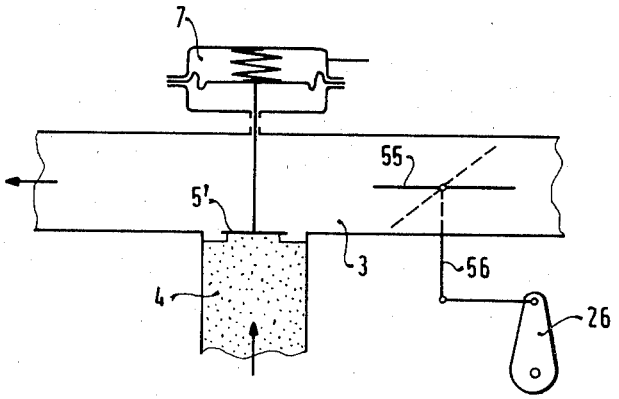
FIG. 4 shows a third exemplary and schematic embodiment of the invention, having a throttle valve actuated in accordance with the position of the adjusting lever and disposed upstream of the point of discharge of the exhaust recirculation line into the intake tube.

FIG. 4 shows a supplementary device for effecting the recirculated exhaust gas quantities. Here, in an embodiment which is otherwise identical to that shown in FIGS. 1 and 3, the exhaust recirculation valve 5' is provided directly at the point of discharge of the exhaust recirculation line 4 into the intake tube 3. The exhaust recirculation valve 5 is actuated in the same manner by means of a pneumatic servomotor 7. As a modification, however, a throttle valve 55 is provided in the intake tube 3 upstream of the point of discharge of the exhaust recirculation line 4, and the throttle valve 55 is connected with the adjusting lever 26 via a linkage 56.

With a suitable adaptation of the linkage 56, the throttle valve 55 can be displaced by the adjusting lever in accordance with the position of the adjusting lever in such a manner that when the exhaust recirculation valve 5' is opened the quantity of the recirculated exhaust gas can be continually adapted by throttling the supply of fresh air. For instance, it is possible to recirculate a small quantity of exhaust gas at a very low load and a large quantity of exhaust gas at a load approaching the threshold position of the adjusting lever 26, by means of more severely throttling the supply of fresh air in the latter case.

Figure 5:
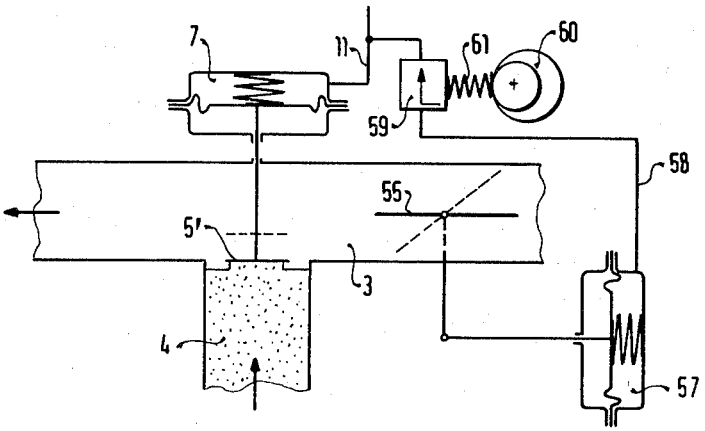
FIG. 5 shows a fourth exemplary and schematic embodiment of the invention, which is a modification of the embodiment shown in FIG. 4, having a throttle device controlled by auxiliary force disposed upstream of the point of discharge of the exhaust recirculation line into the intake tube.

FIG. 5 shows a form of embodiment modified from that shown in FIG. 4. Here, in order to actuate the throttle valve 55, a pneumatic servomotor 57 is provided in the intake tube 3 upstream of the point of discharge of the exhaust gas recirculation line 4. This servomotor 57 may be connected, for instance via a control line 58, with the pressure line 11 between the switching valve 13 and the pneumatic servomotor 7. A pressure control valve 59 is disposed in the control line 58 and is controlled by a cam wheel 60 driven by the adjusting lever 26. The control spring 61 of the pressure control valve 59 is displaced in accordance with the shape of the cam wheel 60. The exhaust gas recirculation quantities can then be adapted in many variations to the operational ranges prevailing at a particular time with the exhaust recirculation valve 5' being open.

In the case of the actuation of the throttle valve 55 with the aid of a pneumatic servomotor 57 and with an interposed pressure control valve 59, there is also the possibility of performing the adjustment of the throttle valve 55 as well in accordance with the rpm or with the underpressure in the intake tube 3, or by an appropriate combination of the control signals mentioned. It is thus possible to attain further adaptations of the exhaust gas recirculation quantity to operating conditions of the engine.

The adjustment of the exhaust recirculation valve can naturally also be effected by hydraulic means or by some other auxiliary force, such as an electromotor or an adjusting magnet. In the case of a pneumatic or hydraulic means, it is also possible to perform the triggering of the switching valve pneumatically or hydraulically, just as it is also possible to realize the triggering by electronic means. With the apparatuses described, it is possible to adapt the exhaust recirculation quantity in a manner which is simple and functionally reliable to the various operational points of the engine, so that the largest possible permissible exhaust recirculation rate is always assured.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In combination with an exhaust gas recirculation device and a governor spring adjusting lever of a fuel injection pump of an internal combustion engine, said exhaust gas recirculation device including an exhaust gas recirculating line, an exhaust gas throttle device disposed in the exhaust gas recirculating line and an exhaust gas adjusting device disposed to actuate the exhaust gas throttle device, an improved apparatus for controlling the exhaust gas recirculating device, comprising:

switching means connected to the exhaust gas adjusting device;

control means connecting the switching means to the governor spring adjusting lever, and being responsive to the setting of the governor spring adjusting lever such that;

(a) said switching means actuates the exhaust gas adjusting device causing the exhaust gas throttle means to open thereby permitting exhaust gas recirculation for all settings of the governor spring adjusting lever less than a predetermined setting; and (b) said switching means actuates the exhaust gas adjusting device causing the exhaust gas throttle means to close thereby blocking exhaust gas recirculation for all settings of the governor spring adjusting lever greater than a predetermined setting.

2. The apparatus as defined in claim 1, wherein:

(i) said switching means includes a first switch; and (ii) said control means includes a cam disc connected to control said first switch.

3. The apparatus as defined in claim 1, wherein:

(i) said switching means includes a first switch and a switching valve connected to the first switch; and (ii) said switching valve is connected to the exhaust gas adjusting device and controls the supply of auxiliary energy to the exhaust gas adjusting device.

4. The apparatus as defined in claim 3, further wherein:

(iii) said switching means includes an electric current supply line to which the first switch and the switching valve are connected, said first switch controlling the current flow through said electric current supply line to said switching valve.

5. The apparatus as defined in claim 3, further wherein:

(iii) said switch means includes a vacuum source connected via the switching valve to the exhaust gas adjusting device; and (iv) the exhaust gas adjusting device comprises a pneumatic adjusting device having a work chamber subjected to the vacuum source.

6. The apparatus as defined in claim 1, wherein the combination further comprises: the engine intake tube; and a throttle valve disposed in the intake tube upstream of the point of discharge of the exhaust gas recirculation line into the intake tube, said throttle valve being controllable in accordance with engine operating parameters.

7. The apparatus as defined in claim 6, wherein the combination further comprises: an auxiliary energy source; and adjusting means for the throttle valve disposed in the intake tube, said adjusting means for the throttle valve being actuated by auxiliary energy supplied from the auxiliary energy source in accordance with engine operating parameters.

8. The apparatus as defined in claim 7, wherein the combination further comprises: a pressure control valve, and wherein the auxiliary energy is a vacuum the supply of which is controlled by said pressure control valve.

9. The apparatus as defined in claim 1, wherein the throttle valve disposed in the intake tube is controlled by the position of the governor spring adjusting lever.

10. In combination with a fuel injection pump and an exhaust gas recirculation device of an internal combustion engine, said injection pump including a fuel quantity adjusting device, a governor spring connected to the fuel quantity adjusting device, a governor spring adjusting lever acting via the governor spring on the fuel quantity adjusting device and a mechanical rpm transducer including an adjusting member, said exhaust gas recirculation device including an exhaust gas recirculation line, an exhaust gas throttle device disposed in an exhaust gas adjusting device disposed to actuate the exhaust gas throttle device, an improved apparatus for controlling the exhaust gas recirculating device, comprising:

switching means connected to the fuel injection pump and the exhaust gas adjusting device; and control means connecting the switching means to the governor spring adjusting lever, wherein the exhaust gas adjusting device is activated causing the exhaust gas throttle means to open thereby permitting exhaust gas recirculation when both of the following conditions exist:

(a) the setting of the governor spring adjusting lever is less than a predetermined setting; and (b) the setting of the adjusting member of the mechanical rpm transducer is less than a predetermined setting.

11. The apparatus as defined in claim 7, further wherein:

(i) said switching means includes a first switch, a second switch connected in series therewith, said second switch comprising a pressure switch, and a throttle located downstream of said pressure switch;

(ii) said fuel injection pump further including a fuel-filled suction chamber and an outflow line connected to the throttle and pressure switch, the flow of fuel through said outflow line being controlled by said mechanical rpm transducer; and (iii) said mechanical rpm transducer further including metering means formed partly by said adjusting member, said metering means being connected to said overflow line.

12. The apparatus as defined in claim 10, wherein the combination further comprises: the engine intake tube; and a throttle valve disposed in the intake tube upstream of the point of discharge of the exhaust gas recirculation line into the intake tube, said throttle valve being controllable in accordance with engine operating parameters.

13. The apparatus as defined in claim 12, wherein the combination further comprises: an auxiliary energy source; and adjusting means for the throttle valve disposed in the intake tube, said adjusting means for the throttle valve being actuated by auxiliary energy supplied from the auxiliary energy source in accordance with engine operating parameters.

14. The apparatus as defined in claim 13, wherein the combination further comprises: a pressure control valve, and wherein the auxiliary energy is a vacuum the supply of which is controlled by said pressure control valve.

15. The apparatus as defined in claim 10 wherein the throttle valve disposed in the intake tube is controlled by the position of the governor spring adjusting lever.

16. In combination with an exhaust gas recirculating device and a governor spring adjusting lever of a fuel injection pump of an internal combustion engine, said exhaust gas recirculating device including an exhaust gas recirculating line, an exhaust gas throttle device disposed in the exhaust gas recirculating line and an exhaust gas adjusting device disposed to actuate the exhaust gas throttle device, an improved apparatus for controlling the exhaust gas recirculating device, comprising:

engine rpm transducer mens;

switching means connected to the exhaust gas adjusting device and the engine rpm transducer means; and control means connecting the switching means to the governor spring adjusting lever, wherein the exhaust gas adjusting device is activated causin the exhaust gas throttle means to open thereby permitting exhaust gas recirculation when both of the following conditions exist:

(a) the setting of the governor spring adjusting lever is less than a predetermined setting; and (b) the output of the engine rpm transducer means is within a predetermined range.

17. The apparatus as defined in claim 16, further wherein:

(i) said switching means includes a normally closed switch; and (ii) said engine rpm transducer means generates a signal which opens said normally closed switch whenever a given threshold rpm value is exceeded.

18. The apparatus as defined in claim 16, further wherein:

(i) said switching means includes a normally closed switch; and (ii) said engine rpm transducer means generates a signal which opens said normally closed switch whenever the engine rpm sensed is less than a predetermined value.

19. The apparatus as defined in claim 16, wherein the combination further comprises: the engine intake tube; and a throttle valve disposed in the intake tube upstream of the point of discharge of the exhaust gas recirculation line into the intake tube, said throttle valve being controllable in accordance with engine operating parameters.

20. The apparatus as defined in claim 19, wherein the combination further comprises: an auxiliary energy source; and adjusting means for the throttle valve disposed in the intake tube, said adjusting means for the throttle valve being actuated by auxiliary energy supplied from the auxiliary energy source in accordance with engine operating parameters.

21. The apparatus as defined in claim 20, wherein the combination further comprises: a pressure control valve, and wherein the auxiliary energy is a vacuum tube supply of which is controlled by said pressure control valve.

22. The apparatus as defined in claim 19, wherein the throttle valve disposed in the intake tube is controlled by the position of the governor spring adjusting lever.

23. In combination with a fuel injection pump and an exhaust gas recirculation device of an internal combustion engine, said injection pump including a fuel quantity adjusting device, a governor spring connected to the fuel quantity adjusting device, a governor spring adjusting lever acting via the governor spring on the fuel quantity adjusting device and a mechanical rpm transducer connected to the fuel quantity adjusting device, said mechanical rpm transducer including an adjusting member, said exhaust gas recirculation device including an exhaust gas recirculating line, an exhaust gas throttle device disposed in the exhaust gas recirculation line and an exhaust gas adjusting device disposed to actuate the exhaust gas throttle device, an improved apparatus for controlling the exhaust gas recirculating device, comprising:

engine rpm transducer means;

switching means connected to the fuel injection pump, the exhaust gas adjusting device and the engine rpm transducer means; and control means connecting the switching means to the governor spring adjusting lever, wherein the exhaust gas adjusting device is actuated causing the exhaust gas throttle means to open thereby permitting exhaust gas recirculation when all of the following conditions exist:

(a) the setting of the governor spring adjusting lever is less than a predetermined setting;

(b) the setting of the adjusting member of the mechanical rpm transducer is less than a predetermined setting; and (c) the output of the engine rpm transducer means is within a predetermined range.

24. The apparatus as defined in claim 23, further wherein:

(i) said switching means includes a first switch and a switching valve connected to the first switch; and (ii) said switching valve is connected to the exhaust gas adjusting device and controls the supply of auxiliary energy to the exhaust gas adjusting device.

25. The apparatus as defined in claim 24, further wherein:

(iii) said switching means includes a second switch and a third switch and an electric current supply line to which the first, second and third switches and the switching valve are connected, said first, second and third switches controlling the current flow through said electric current supply line to said switching valve.

26. The apparatus as defined in claim 24, further wherein:

(iii) said switching means includes a vacuum source connected via the switching valve to the exhaust gas adjusting device; and (iv) the exhaust gas adjusting device comprises a pneumatic adjusting device having a work chamber subjected to the vacuum source.

27. The apparatus as defined in claim 23, wherein the combination further comprises: the engine intake tube; and a throttle valve disposed in the intake tube upstream of the point of discharge of the exhaust gas recirculation line into the intake tube, said throttle valve being controllable in accordance with engine operating parameters.

28. The apparatus as defined in claim 27, wherein the combination further comprises: an auxiliary energy source; and adjusting means for the throttle valve disposed in the intake tube, said adjusting means for the throttle valve being actuated by auxiliary energy supplied from the auxiliary energy source in accordance with engine operating parameters.

29. The apparatus as defined in claim 28, wherein the combination further comprises: a pressure control valve, and wherein the auxiliary energy is a vacuum the supply of which is controlled by said pressure control valve.

30. The apparatus as defined in claim 27, wherein the throttle valve disposed in the intake tube is controlled by the position of the governor spring adjusting lever.

* * * * *